US010782105B2

(12) United States Patent
Sloman

(10) Patent No.: US 10,782,105 B2
(45) Date of Patent: Sep. 22, 2020

(54) VEHICLE STABILIZATION

(71) Applicant: Advanced Blast & Ballistic Systems Limited, Derby (GB)

(72) Inventor: Roger Mark Sloman, Ashbourne (GB)

(73) Assignee: Advanced Blast & Ballistic Systems Limited, Derby (GB)

( * ) Notice: Subject to any disclaimer, the term of this patent is extended or adjusted under 35 U.S.C. 154(b) by 347 days.

(21) Appl. No.: 15/901,750

(22) Filed: Feb. 21, 2018

(65) Prior Publication Data

US 2018/0238660 A1 Aug. 23, 2018

Related U.S. Application Data

(63) Continuation of application No. 13/133,280, filed as application No. PCT/GB2009/051609 on Nov. 27, 2009, now abandoned.

(30) Foreign Application Priority Data

Dec. 10, 2008 (GB) ..... 0822444.6

(51) Int. Cl.

| | |
|---|---|
| ***F41H 7/00*** | (2006.01) |
| ***F41H 7/02*** | (2006.01) |
| ***F41H 7/04*** | (2006.01) |
| ***F41H 5/007*** | (2006.01) |

(52) U.S. Cl.

CPC ..... *F41H 7/02* (2013.01); *F41H 5/007* (2013.01); *F41H 7/044* (2013.01)

(58) Field of Classification Search

None

See application file for complete search history.

(56) References Cited

U.S. PATENT DOCUMENTS

| | | | |
|---|---|---|---|
| 2,906,176 | A | 9/1959 | Musser |
| 3,580,354 | A | 5/1971 | Hewitt |
| 4,686,888 | A | 8/1987 | Sanborn et al. |
| 6,658,984 | B2 | 12/2003 | Zonak |
| 6,938,924 | B2 | 9/2005 | Feldman et al. |
| 7,594,561 | B2 | 9/2009 | Hass et al. |
| 7,908,959 | B2 | 3/2011 | Pavon |

(Continued)

FOREIGN PATENT DOCUMENTS

| | | |
|---|---|---|
| DE | 2121089 | 11/1972 |
| DE | 2205826 A1 | 8/1973 |

(Continued)

OTHER PUBLICATIONS

Communication pusuant to Rule 114(2) EPC, from related EP Application 09764016.3, dated Apr. 18, 2012, 4 pages.

(Continued)

*Primary Examiner* — Truc M Do

(74) *Attorney, Agent, or Firm* — Lee & Hayes, P.C.

(57) ABSTRACT

A vehicle, comprising: pressure detection means; vehicle stabilizing means; means for receiving an input from the pressure detection means, in response to the pressure detection means detecting an increase in pressure caused by an explosion; and control means for controlling, in response to reception of the input from the pressure detecting means, the vehicle stabilizing means to apply a force to the vehicle, in order to stabilize the vehicle in response to the explosion.

7 Claims, 8 Drawing Sheets

(56) References Cited

U.S. PATENT DOCUMENTS

| | | | | |
|---|---|---|---|---|
| 8,025,005 | B2 | 9/2011 | Pavon | |
| 8,095,269 | B2 | 1/2012 | Pruett et al. | |
| 8,240,748 | B2 | 8/2012 | Chapman | |
| 8,316,753 | B2 | 11/2012 | Beach et al. | |
| 8,342,073 | B2 | 1/2013 | Chu et al. | |
| 8,353,240 | B1 | 1/2013 | Schaedler et al. | |
| 8,365,649 | B1 | 2/2013 | Andrews | |
| 8,424,443 | B2 | 4/2013 | Gonzalez | |
| 8,459,167 | B1 | 6/2013 | Gonzalez | |
| 8,464,626 | B2 | 6/2013 | Adams et al. | |
| 8,464,816 | B2 | 6/2013 | Carrier | |
| 8,636,972 | B1 | 1/2014 | Imholt | |
| 8,739,676 | B2 | 6/2014 | Ames | |
| 9,163,911 | B2 | 10/2015 | Sloman | |
| 2003/0167956 | A1* | 9/2003 | Kellner | F42B 12/204 102/517 |
| 2004/0050063 | A1* | 3/2004 | Schmotolocha | F23C 7/006 60/767 |
| 2004/0200347 | A1 | 10/2004 | Grosch | |
| 2005/0230176 | A1 | 10/2005 | Wang | |
| 2007/0186762 | A1 | 8/2007 | Dehart et al. | |
| 2009/0266226 | A1 | 10/2009 | Beach et al. | |
| 2010/0102596 | A1 | 4/2010 | Chapman | |
| 2010/0163330 | A1 | 7/2010 | Halliday | |
| 2010/0185354 | A1 | 7/2010 | Pruett et al. | |
| 2010/0275766 | A1 | 11/2010 | Joynt et al. | |
| 2011/0072960 | A1 | 3/2011 | Hallissy et al. | |
| 2011/0148147 | A1 | 6/2011 | Tunis et al. | |
| 2011/0245994 | A1 | 10/2011 | Sloman | |
| 2012/0180642 | A1 | 7/2012 | Pavon | |
| 2012/0185129 | A1 | 7/2012 | Carrier | |
| 2012/0192706 | A1 | 8/2012 | Gonzalez | |
| 2012/0193940 | A1 | 8/2012 | Tunis et al. | |
| 2012/0247315 | A1 | 10/2012 | Treadway et al. | |
| 2013/0036899 | A1 | 2/2013 | Tucker | |
| 2013/0061739 | A1 | 3/2013 | Cheong et al. | |
| 2013/0092016 | A1 | 4/2013 | Sales | |
| 2013/0152774 | A1 | 6/2013 | Gonzalez | |
| 2013/0204496 | A1 | 8/2013 | Sloman | |
| 2013/0284003 | A1 | 10/2013 | Dodworth | |
| 2013/0319215 | A1 | 12/2013 | Parida et al. | |
| 2014/0007761 | A1 | 1/2014 | Haidar | |
| 2014/0214281 | A1 | 7/2014 | Welker et al. | |
| 2014/0224110 | A1 | 8/2014 | Sagebiel et al. | |
| 2015/0345912 | A1 | 12/2015 | Svane et al. | |
| 2016/0116256 | A1 | 4/2016 | Sloman | |

FOREIGN PATENT DOCUMENTS

| | | | |
|---|---|---|---|
| DE | 4305616 | A1 | 8/1994 |
| DE | 19631715 | A1 | 2/1998 |
| DE | 19702398 | C1 | 7/1998 |
| DE | 19842629 | C1 | 3/2000 |
| DE | 19909905 | A1 | 2/2001 |
| DK | 200900389 | A1 | 2/2015 |
| EP | 1045220 | A2 | 10/2000 |
| EP | 1293747 | A2 | 3/2003 |
| EP | 1431700 | A1 | 6/2004 |
| FR | 3022619 | A1 | 12/2015 |
| GB | 2302526 | A | 1/1997 |
| WO | WO200239048 | A2 | 5/2002 |
| WO | WO03004958 | A2 | 1/2003 |
| WO | WO2006037314 | A1 | 4/2006 |
| WO | WO2006108613 | A1 | 10/2006 |
| WO | WO2010067093 | A1 | 6/2010 |
| WO | WO2011075174 | A1 | 6/2011 |
| WO | WO2011148118 | A1 | 12/2011 |

OTHER PUBLICATIONS

EP Search Report for Application No. 14151928.0-1655, dated Mar. 27, 2014, 6 pages.

EP Search Report for Application No. 14167383.0-1503, dated Jul. 22, 2014, 4 pages.

International Search Report for PCT/GB2010/051732 dated Jul. 21, 2011, 7 pages.

North Atlantic Treaty Organisation, Research and Technology Organisation, "Test Methodology for Protection of Vehicle Occupants Against Anti-Vehicular Landmine Effects," Final Report of HFM-090 Task Group 25, RTO Technical Report, TR-HFM-090, Apr. 2007, 8 pages.

Office action for U.S. Appl. No. 13/133,280, dated Nov. 20, 2015, Sloman et al., "Vehicle Stabilization", 7 pages.

Office action for U.S. Appl. No. 13/133,280, dated Nov. 30, 2016, Sloman, "Vehicle Stabilization", 6 pages.

Final Office Action for U.S. Appl. No. 13/133,280, dated Feb. 24, 2014, Roger Mark Sloman, "Vehicle Stabilization", 9 pages.

Office Action for U.S. Appl. No. 13/700,245, dated Mar. 3, 2015, Roger Mark Sloman, "Vehicle Stabilization in the Event of Large Detonation", 9 pages.

Office Action for U.S. Appl. No. 13/700,245, dated Mar. 7, 2014, Roger Mark Sloman, "Vehicle Stabilization in the Event of Large Detonation", 10 pages.

Office Action for U.S. Appl. No. 13/133,280, dated May 13, 2015, Roger Mark Sloman, "Vehicle Stabilization", 6 pages.

Office action for U.S. Appl. No. 13/133,280, dated May 19, 2016, Sloman, "Vehicle Stabilization", 6 pages.

Office action for U.S. Appl. No. 13/133,280 dated Jun. 5, 2017, Sloman, "Vehicle Stabilization", 6 pages.

Office action for U.S. Appl. No. 13/133,280 dated Sep. 11, 2014, Sloman, "Vehicle Stabilization", 8 pages.

Office action for U.S. Appl. No. 13/700,245, dated Sep. 18, 2014, Sloman et al., "Vehicle Stabilization in the Event of Large Detonation", 14 pages.

Invitation to Respond to Written Opinion from the Intellectual Property Office of Singapore, Application No. 2012086260, dated Feb. 28, 2014, 7 pgs.

International Search Report from corresponding International Application No. PCT/GB2009/051609, dated Nov. 27, 2009, 16 pages.

Final Office Action for U.S. Appl. No. 13/133,280, dated Jun. 1, 2018, Roger Mark Sloman, "Vehicle Stabilization", 9 pages.

* cited by examiner

VEHICLE STABILIZATION

FIELD OF THE INVENTION

Embodiments of the present invention relate to vehicle stabilization. In particular, they relate to stabilizing an armoured vehicle in response to an explosion.

BACKGROUND TO THE INVENTION

Armoured vehicles comprise armour for protecting the vehicle and its occupants against projectiles, shrapnel and blast emanating from explosive devices, such as mines or improvised explosive devices (IED's).

BRIEF DESCRIPTION OF VARIOUS EMBODIMENTS OF THE INVENTION

According to various, but not necessarily all, embodiments of the invention there is provided a vehicle, comprising: pressure detection means; vehicle stabilizing means; means for receiving an input from the pressure detection means, in response to the pressure detection means detecting an increase in pressure caused by an explosion; and control means for controlling, in response to reception of the input from the pressure detecting means, the vehicle stabilizing means to apply a force to the vehicle, in order to stabilize the vehicle in response to the explosion.

According to various, but not necessarily all, embodiments of the invention there is provided apparatus, comprising: pressure detection means; vehicle stabilizing means for applying a force to a vehicle; means for receiving an input from the pressure detection means, in response to the pressure detection means detecting an increase in pressure caused by an explosion; and control means for controlling, in response to reception of the input from the pressure detecting means, the vehicle stabilizing means to apply a force to the vehicle, in order to stabilize the vehicle in response to the explosion.

The control means may be for controlling the vehicle stabilizing means in dependence upon at least one characteristic of the input from the pressure detecting means. The at least one characteristic of the input may indicate, to the control means, the magnitude of the increase in pressure caused by the explosion. The control means may be for controlling the vehicle stabilizing means in dependence upon the indicated magnitude.

The at least one characteristic may indicate, to the control means, a position at which pressure has increased due to the explosion. The control means may be for controlling the vehicle stabilizing means in dependence upon the indicated position.

The control means may be for controlling the vehicle stabilizing means in dependence upon predetermined control information. The predetermined control information may depend upon the shape, material of construction, weight and/or the centre of gravity of the vehicle.

The vehicle may comprise a body. The pressure detection means may be provided at the underside and/or sides of the body. The pressure detection means may comprise one or more pressure detectors.

The vehicle stabilizing means may be for applying a force having a groundwards component to the vehicle, in order to stabilize the vehicle in response to the explosion. The vehicle stabilizing means may comprise one or more vehicle stabilizing devices. The one or more vehicle stabilizing devices may include one or more rocket motors.

The vehicle may be an armoured vehicle. The armoured vehicle may be land-based.

According to various, but not necessarily all, embodiments of the invention there is provided a method, comprising: detecting an increase in pressure caused by an explosion; and controlling, in response to detection of the increase in pressure, vehicle stabilizing means to apply a force to a vehicle, in order to stabilize the vehicle in response to the explosion.

The vehicle stabilizing means may be controlled in dependence upon at least one characteristic of the increase in pressure. The vehicle stabilizing means may be controlled in dependence upon the magnitude of the increase in pressure caused by the explosion.

The vehicle stabilizing means may be controlled in dependence upon a position at which the pressure has increased due to the explosion. The vehicle stabilizing means may be controlled in dependence upon the velocity, weight and/or the location of the centre of gravity of the vehicle.

A computer program comprising computer program instructions that, when executed by a processor, enable the method as described above to be performed.

According to various, but not necessarily all, embodiments of the invention there is provided a processor, comprising: a processor interface configured to receive an input from at least one pressure detector, in response to the at least one pressure detector detecting an increase in pressure caused by an explosion; and functional processing circuitry configured, in response to reception of the input from the at least one pressure detector, to control the vehicle stabilizing means to apply a force to the vehicle, in order to stabilize the vehicle in response to the explosion.

According to various, but not necessarily all, embodiments of the invention there is provided a vehicle, comprising: at least one pressure detector; at least one vehicle stabilizing device; an interface configured to receive an input from the at least one pressure detector, in response to the at least one pressure detector detecting an increase in pressure caused by an explosion; and processing circuitry configured, in response to reception of the input from the at least one pressure detector, to control the at least one vehicle stabilizing device to apply a force to the vehicle, in order to stabilize the vehicle in response to the explosion.

According to various, but not necessarily all, embodiments of the invention there is provided apparatus, comprising: at least one pressure detector; at least one vehicle stabilizing device; an interface configured to receive an input from the at least one pressure detector, in response to the at least one pressure detector detecting an increase in pressure caused by an explosion; and processing circuitry configured, in response to reception of the input from the at least one pressure detector, to control the vehicle stabilizing means to apply a force to a vehicle, in order to stabilize the vehicle in response to the explosion.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 1:
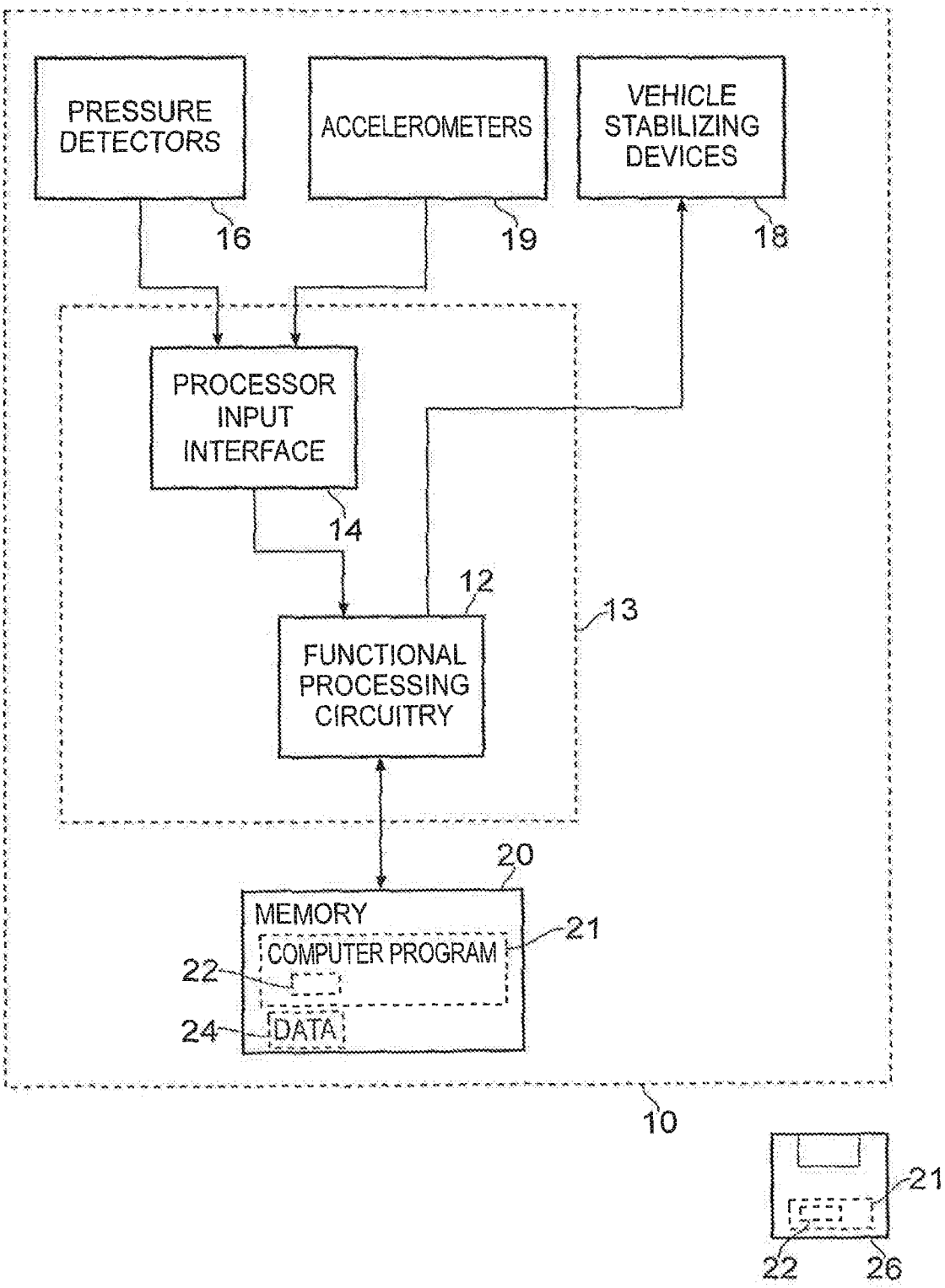
FIG. 1 illustrates an apparatus.

The Figures illustrate a vehicle 2, comprising: pressure detection means 16; vehicle stabilizing means 18; means 14 for receiving an input from the pressure detection means 16, in response to the pressure detection means 16 detecting an increase in pressure caused by an explosion; and control means 12 for controlling, in response to reception of the input from the pressure detecting means 16, the vehicle stabilizing means 18 to apply a force to the vehicle 2, in order to stabilize the vehicle 2 in response to the explosion.

An explosive event can cause significant trauma to a vehicle and/or a vehicle's occupants. In order to protect the occupants of the vehicle from shrapnel and blast emanating from an explosive such as a bomb, mine or improvised explosive device (IED), some vehicles comprise armour.

However, while the armour may protect the occupants against injury caused directly from the shrapnel and blast effects, an explosion underneath or to the side of a vehicle may cause the vehicle to accelerate rapidly into the air, resulting in injury to the occupants either when being accelerated upwards or when the vehicle lands on the ground.

The main upwards acceleration that is generated by the explosion does not occur instantaneously in response to the initial blast shockwave produced by the explosion. Immediately after the explosion occurs, there is an input of energy from the initial shockwave, the following reflected pressure waves, ejecta, and from localised very high pressure gas. There is then a short time interval while gases produced by decomposition of the explosive expand underneath the vehicle. Once sufficient expansion has occurred, the gases may apply a large enough force to cause the vehicle to accelerate upwards into the air and fall onto its side or top. The primary effect of the expanding gases can be likened to a large airbag expanding very rapidly under the vehicle.

Embodiments of the invention relate to an apparatus for stabilizing a vehicle in response to an explosion, in order to prevent or limit injury to the vehicle's occupants, and to maintain the vehicle upright and in fighting condition.

FIG. 1 illustrates an apparatus 10 for stabilizing a vehicle in response to an explosion. The apparatus 10 may be applied to a vehicle during manufacture or post manufacture. The apparatus 10 may, for example, be a kit of parts. The vehicle may be a land-based armoured vehicle. For example, the vehicle may be an armoured car, an armoured personnel carrier or a tank.

The apparatus 10 comprises control means in the form of a processor 13, pressure detectors 16, vehicle stabilizing devices 18, accelerometers 19 and a memory 20. The processor 13 comprises functional processing circuitry 12 and a processor input interface 14.

The processor input interface 14 is configured to receive inputs from the pressure detectors 16 and the accelerometers 19. The processor input interface 14 is also configured to provide the inputs to the functional processing circuitry 12. The functional processing circuitry 12 is configured to provide an output to the vehicle stabilizing device 18 and to write to and read from the memory 20.

The pressure detectors 16 may, for example, be piezoelectric pressure detectors. Advantageously, piezoelectric pressure detectors operate effectively in adverse weather and ground conditions.

The vehicle stabilizing devices 18 are configured to apply a force having a groundwards component to a vehicle. In some embodiments of the invention, some or all of the vehicle stabilizing devices 18 are rocket motors.

The memory 20 is configured to store a computer program 21 comprising computer program instructions 22 and data 24. The data 24 may include control information. The control information is explained in more detail below.

The computer program instructions 22 control the operation of the apparatus 10 when loaded into the processor 13. The computer program instructions 22 provide the logic and routines that enables the apparatus 10 to perform aspects of the method illustrated in FIG. 5.

The computer program may arrive at the apparatus 10 via any suitable delivery mechanism 26. The delivery mechanism 26 may be, for example, a computer-readable storage medium, a computer program product, a memory device, a record medium such as a CD-ROM or DVD, an article of manufacture that tangibly embodies the computer program instructions 22. The delivery mechanism may be a signal configured to reliably transfer the computer program instructions 22.

In an alternative implementation, the processor 13 and/or the memory 20 may be provided by an application specific integrated circuit (ASIC).

Figure 2:
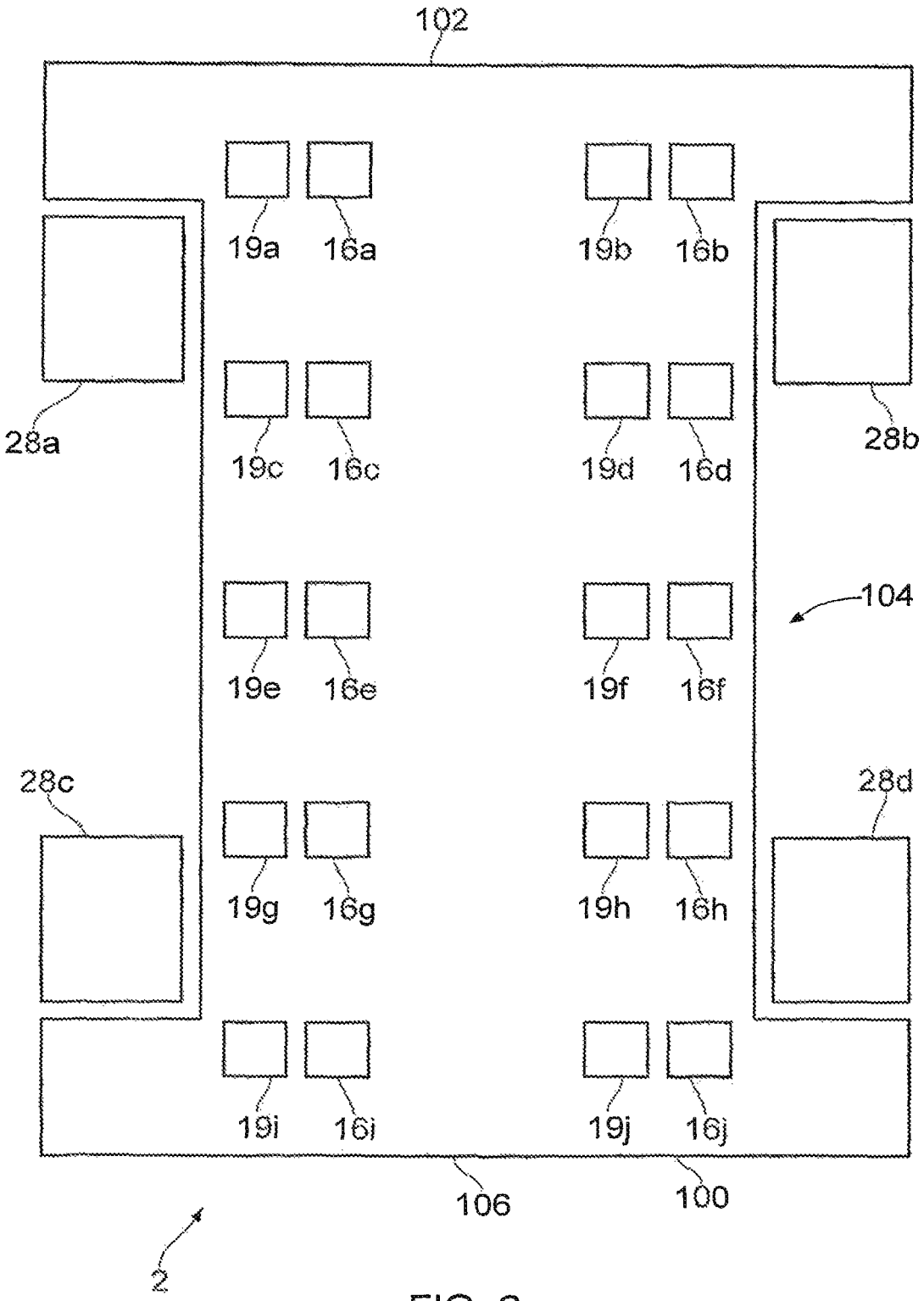
FIG. 2 illustrates the underside of a vehicle.

FIG. 2 illustrates an example of the underside 104 of a vehicle 2 comprising the apparatus 10. The illustrated vehicle 2 comprises a body 100, wheels 28*a* to 28*d*, a plurality of pressure detectors 16*a* to 16*j* and a plurality of accelerometers 19*a* to 19*j*.

Other implementations may have different quantities of wheels, pressure detectors 16 and accelerometers 19 than those illustrated in FIG. 2. Also, in other implementations, the positions of the wheels, pressure detectors 16, accelerometers 19 and may be different to those illustrated in FIG. 2.

Figure 3:
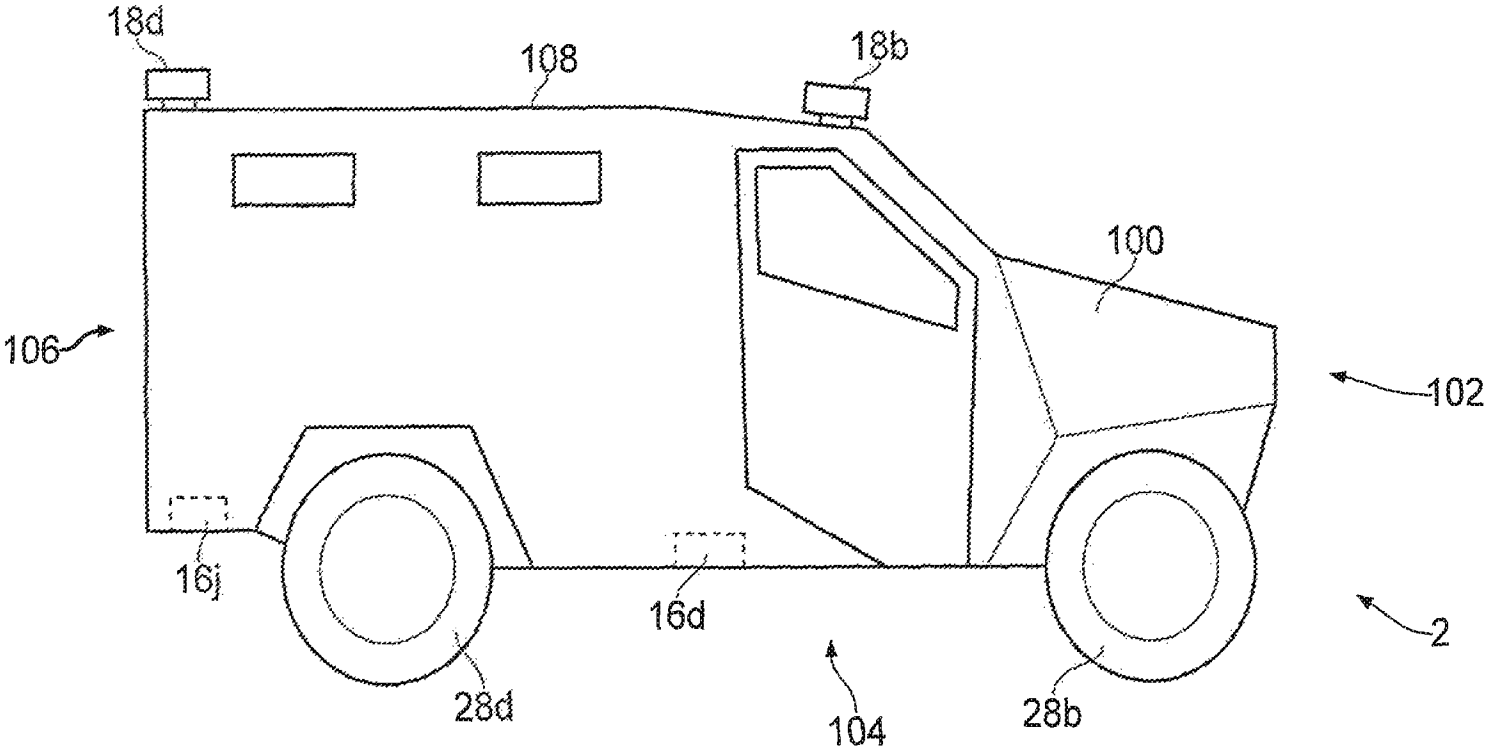
FIG. 3 illustrates a side view of the vehicle.

FIG. 3 illustrates a side view of the vehicle 2 of FIG. 2. The vehicle 2 comprises a plurality of vehicle stabilizing devices 18*a* to 18*d* attached to the roof 108 of the vehicle 2.

Figure 4:
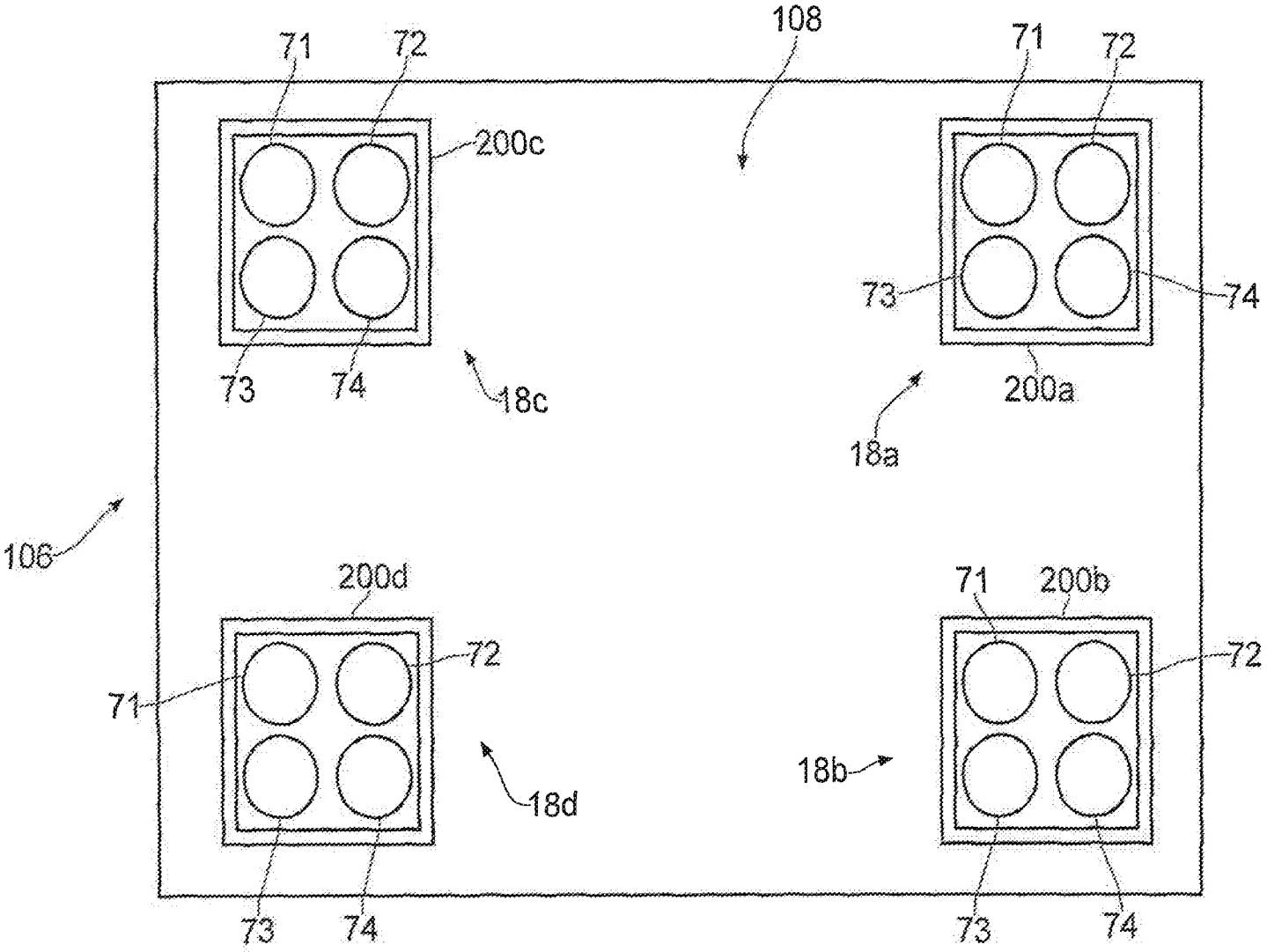
FIG. 4 illustrates a plan view of the roof of the vehicle.

FIG. 4 illustrates a plan view of the roof 108 of the vehicle 2. Each vehicle stabilizing device 18*a* to 18*d* comprises a housing 200*a* to 200*d* which is coupled to the vehicle 2. In FIG. 4, each vehicle stabilizing device 18*a* to 18*d* is illustrated as comprising four rocket motors 71-74. However, it will be appreciated by those skilled in the art that each vehicle stabilizing device 18*a* to 18*d* may comprise any number of rocket motors. Each rocket motor may be wholly contained within its corresponding housing.

In the FIG. 4 example, the vehicle stabilizing devices 18*a* to 18*d* are located at the four corners of the roof 108. Two of the vehicle stabilizing devices 18*a* and 18*b* are located towards the front 102 of the vehicle 2. Two of the vehicle stabilizing devices 18*c* and 18*d* are located towards the rear 106 of the vehicle 2.

While four vehicle stabilizing devices 18 are illustrated in FIG. 4, different quantities of vehicle stabilizing devices 18 may be provided in other implementations. The vehicle stabilizing devices 18 may also be situated in different positions to those illustrated in FIG. 4.

A method according to the embodiments of the invention will now be described in relation to FIG. 5. Initially, an explosion occurs at a position that is external to the vehicle 2. The explosion may, for example, occur underneath, in front of, behind or at a side of the vehicle 2. The explosion may occur as a result of the triggering of a bomb, mine or IED (by the vehicle 2 or otherwise).

The explosion causes an initial blast shockwave. At block 400 of FIG. 5, the pressure detectors 16 of the apparatus 10 detect that an increase in pressure has occurred, local to the vehicle, as a result of the initial blast shockwave. The pressure detectors 16 may, for example, detect that pressure has increased underneath the vehicle 2, at a side of the vehicle 2, at the front of the vehicle 2 or at the rear of the vehicle 2.

In response to detecting the increase in pressure, the pressure detectors 16 provide an input to the processor input interface 14. The input may, for example, indicate the direction in which pressure increased as a result of the explosion, the duration of time over which the pressure increased and/or the extent to which the pressure increased as a result of the explosion.

The processor input interface 14 provides the input from the pressure detectors 16 to the functional processing circuitry 12. The functional processing circuitry 12 then analyzes the input in order to determine whether the input is indicative of an explosion having occurred. An input provided by the pressure detectors 16 following an explosion will have particular characteristics (and will reflect the characteristics of the initial blast shockwave). For example, the input may be indicative of a very large increase in pressure over a very short period of time.

Figure 5:
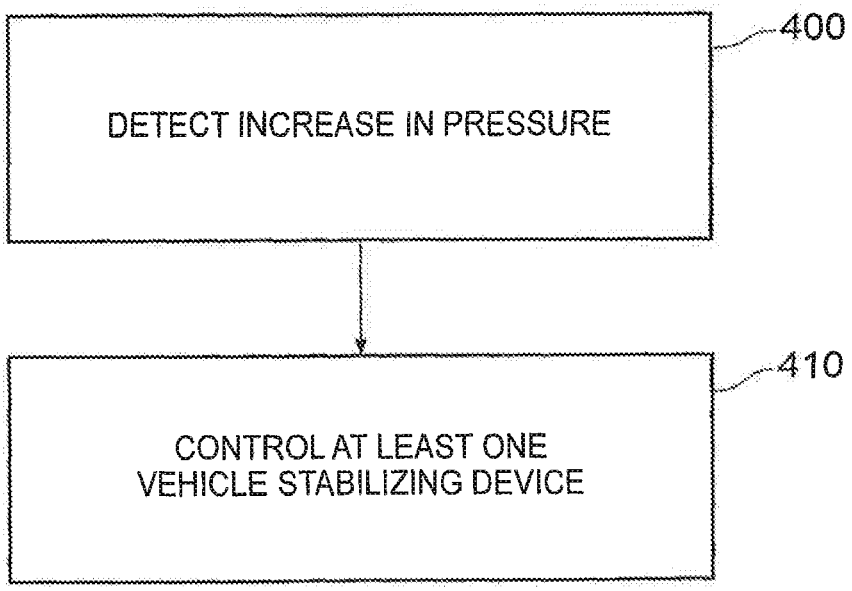
FIG. 5 illustrates a schematic of a method.

After the functional processing circuitry 13 has determined that an explosion has occurred, at block 410 of FIG. 5, the functional processing circuitry 14 controls the vehicle stabilizing devices 18 to apply a force having a groundwards component to the vehicle 2, in order to stabilize the vehicle 2 in response to the explosion.

The functional processing circuitry 12 may, for example, control the vehicle stabilizing devices 18 in dependence upon one or more characteristics of the input from the pressure detectors 16. The input from the pressure detectors may indicate, to the functional processing circuitry 12, the magnitude of the increase in pressure caused by the explosion, and/or the position(s) at which pressure has increased due to the explosion.

The data 24 stored in the memory 20 may include predetermined control information specifying how the vehicle stabilizing devices 18 are to be controlled when different inputs are received from the pressure detectors 16. The data 24 may, for example, be stored in the form of a look up table.

The control information may be determined during a testing procedure. Different control information may be provided for different vehicles. The control information may, for example, depend upon the shape, material of construction, weight and/or the centre of gravity of the vehicle. Different portions of the control information may specify how the vehicle stabilizing devices 18 are to be controlled when the vehicle is travelling at different velocities.

When the input from the pressure detectors 16 is received by the functional processing circuitry 12, the functional processing circuitry 12 matches the input with the appropriate portion of control information. The functional processing circuitry 12 determines how to control the vehicle stabilizing devices from the identified portion of control information and controls the vehicle stabilizing devices 18 appropriately.

In some embodiments of the invention, the functional processing circuitry 12 may obtain inputs (via the input interface 14) from the accelerometers 19 to verify that an explosion has occurred. For example, a mine explosion under a vehicle causes the structure of the vehicle to vibrate in a particular manner. In these embodiments of the invention, the functional processing circuitry 12 may only activate the vehicle stabilizing devices 18 if the input from accelerometers 19 verifies that an explosion has occurred.

In some examples, the input from the pressure detectors may indicate to the functional processing circuitry 12 that some pressure detectors have detected a larger increase in pressure than others. The functional processing circuitry 12 may control a vehicle stabilizing device 18*a*, 18*b*, 18*c*, 18*d* to apply a force (having a groundwards component) to the vehicle 2 that depends upon the increase in pressure that is detected by a pressure detector (or pressure detectors) adjacent to that vehicle stabilizing device 18*a*, 18*b*, 18*c*, 18*d*. When a vehicle stabilizing device 18*a* to 18*d* is activated, some of all of the rocket motors within that vehicle stabilizing device 18*a*, 18*b*, 18*c*, 18*d* may be activated, depending upon the groundwards force that is required.

The order in which each of the pressure detectors 16*a* to 16*j* are activated may, for example, indicate the position at which the explosion has occurred to the functional processing circuitry 12 (relative to the vehicle 2). The functional processing circuitry 12 may activate the vehicle stabilizing devices 18*a* to 18*d* in dependence upon the order in which the pressure detectors 16*a* to 16*j* is activated.

By way of example, consider a situation where an explosion occurs close to the front-right wheel 28*b*. The pressure detectors 16*b* and 16*d* illustrated in FIG. 2 detect a larger increase in pressure than the other pressure detectors 16*a*, 16*c* and 16*e* to 16*j*. The functional processing circuitry 12 may control the vehicle stabilizing device 18*b* situated closest to the pressure detectors 16*b* and 16*d* to apply a larger groundwards force to the vehicle 2 than the other vehicle stabilizing devices 18*a*, 18*c*, 18*d*. The other vehicle stabilizing devices 18*a*, 18*c* and 18*d* may or may not be activated.

The location of the vehicle stabilizing devices 18 may, for example, depend upon the shape of the vehicle 2, and how the vehicle's weight is distributed throughout the vehicle 2. The torque provided to the vehicle 2 by the vehicle stabilizing devices 18 (following activation) may be maximised by locating the vehicle stabilizing devices 18 close to or at the periphery of the vehicle 2. For example, in this regard, the vehicle stabilizing devices 18 may be towards the four corners of the vehicle (see FIG. 4).

The groundwards force applied to the vehicle 2 by the vehicle stabilizing devices 18 acts to mitigate the effects of the total forces generated by the combination of the initial blast shockwave, any reflected shockwaves, ejecta, and the expanding gases resulting from the explosion. Consequently, upwards acceleration of the vehicle 2 is reduced or eliminated, enabling trauma to the vehicle's occupants to be minimised.

In some embodiments of the invention, each of the rocket motors 71-74 of the vehicle stabilizing devices 18*a* to 18*d* may be configured to expel gas in a direction that is substantially perpendicular to and away from the plane defined by the ground that the vehicle 2 is situated on, in order to provide a groundwards force to the vehicle 2. In other embodiments of the invention (depending, for example, on the vehicle design) the direction in which gas is expelled by the rocket motors 71-74 may be offset from the vertical to produce a sidewards force to counteract the effect of mine blasts acting on sloped undersides of the vehicle. In these embodiments of the invention, the groundwards component of the force applied by the rocket motors 71-74 may be larger than the sidewards component.

The rocket motors may, for example, be very short burn motors (e.g. having a burn time of the order of tens of milliseconds) that enable the apparatus 10 to provide a fast response to lifting forces caused by an explosion.

For instance, the upwards force created by typical explosive devices, such as anti-tank mines in the 6 to 10 kg range, may be counteracted by rocket motors containing a weight of propellant that may be approximately the same as, or less than the amount of the explosive substance contained in the device causing the explosion.

In some embodiments of the invention, the thrust profile of the rocket motors may be such that the rocket motors provide a maximum thrust for a short period of time such as 20 to 30 milliseconds after activation, followed by a longer period of lower thrust. This enables the rocket motors to counteract the initially relatively large force that immediately follows the explosion, and then later the lower force that results from residual quasi-static pressure from gaseous detonation products after they have spread out underneath the vehicle.

A tubular rocket motor having the above mentioned thrust profile may be produced by providing propellant having a relatively large diameter near the exit nozzle of the rocket motor, with the diameter of the propellant tapering to a lower diameter along the length of the rocket motor. This may, for example, provide a very rapidly generated, very short maximum thrust burn time of 10 to 20 milliseconds, followed by a further 30 to 150 millisecond sustaining thrust at a lower thrust level. The durations and magnitudes may be adjusted, depending upon the type of the vehicle the rocket motors are fitted to and depending upon the type of explosive device the rocket motors are intended to counteract.

In some implementations, the longer period of lower thrust may not be provided. In these implementations, it is not necessary to taper the diameter of the propellant in the rocket motor.

Figure 6A:
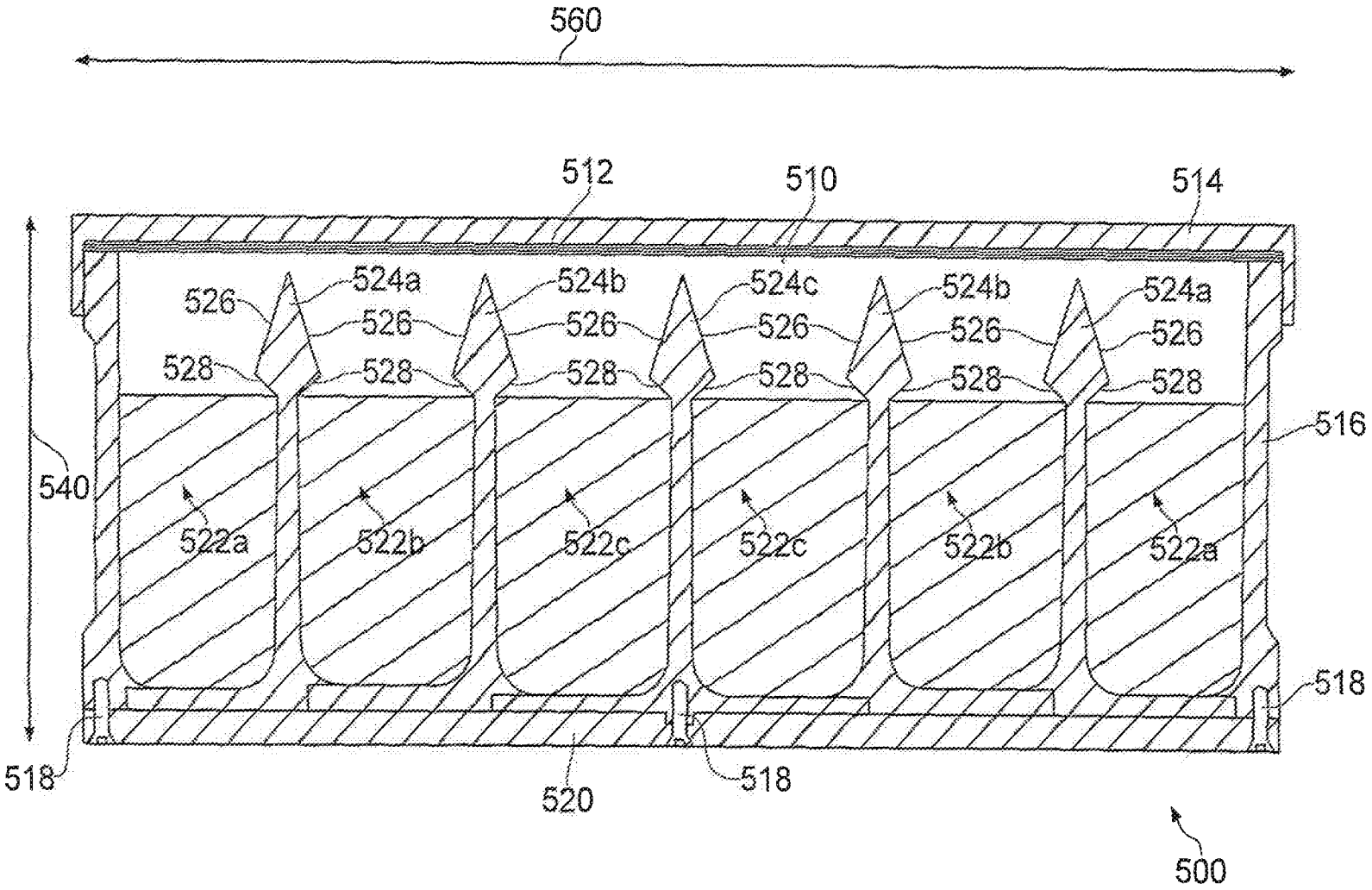
FIG. 6A illustrates a cross section of an exemplary rocket motor.
Figure 6B:
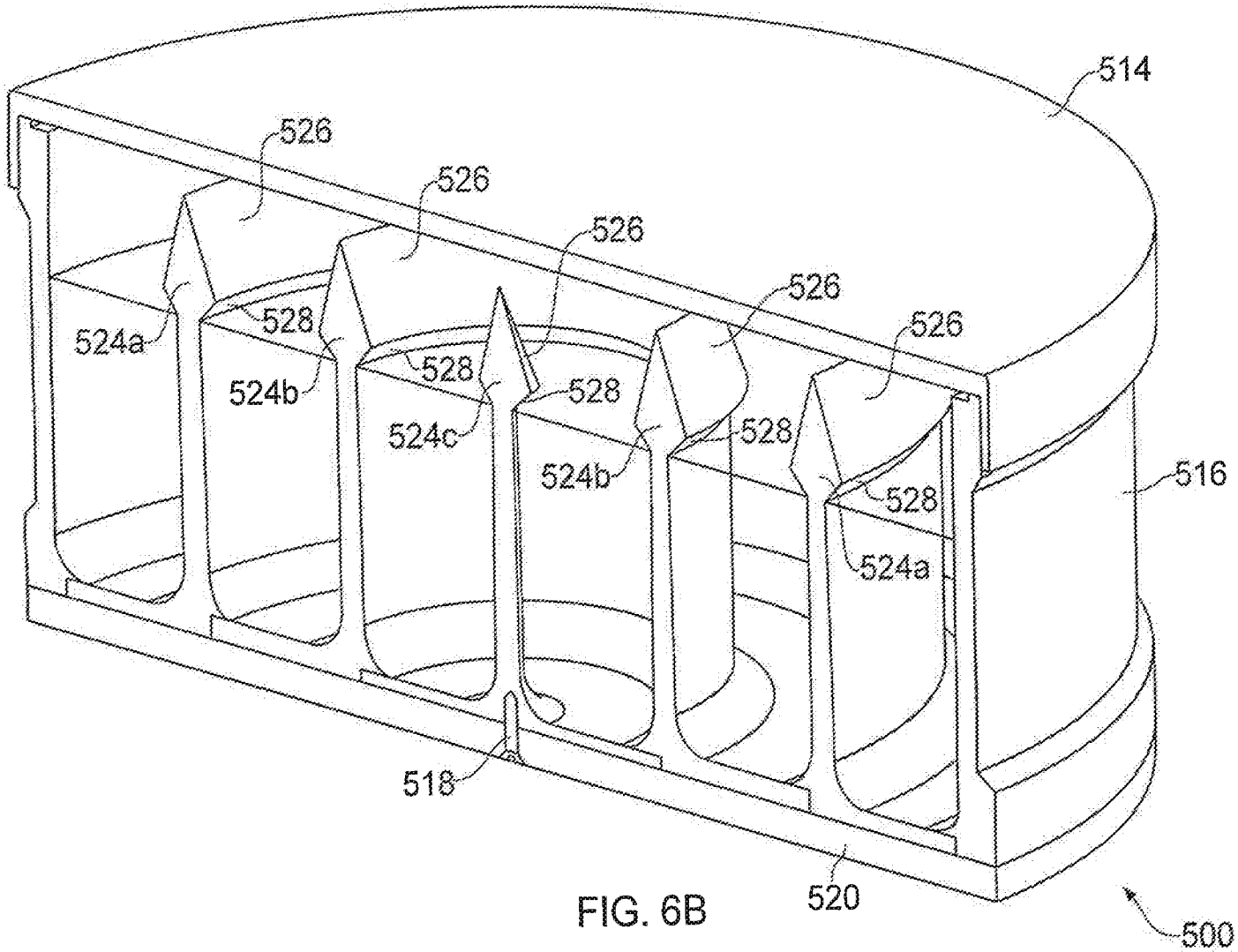
FIG. 6B illustrates a first perspective view of the exemplary rocket motor.
Figure 6C:
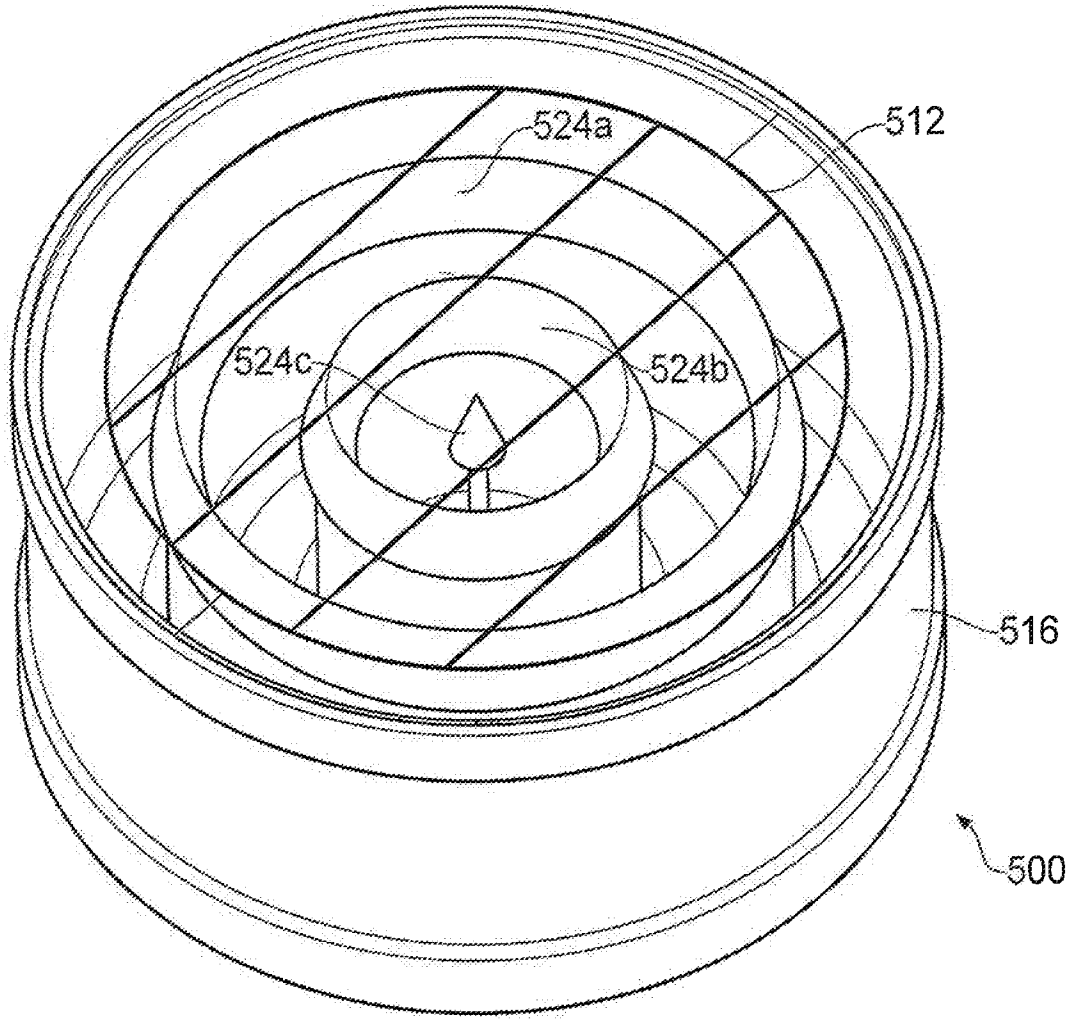
FIG. 6C illustrates a second perspective view of the exemplary rocket motor.

FIGS. 6A, 6B and 6C illustrate an exemplary rocket motor 500. The illustrated rocket motor 500 is substantially cylindrical in shape. The rocket motor 500 comprises a substantially circular base 520 and an annular side wall 516. A cover 514 is provided to protect the rocket motor 500 from projectiles, shrapnel and blast.

FIG. 6A illustrates a cross section of the rocket motor 500. The reference numeral 540 and 560 denote the length and diameter of the rocket motor 500 respectively.

A plurality of propellant regions 522*a*-522*c* is defined in the rocket motor 500 by a plurality of internal dividers 524*a* to 524*c*. An open space 510 is provided between the propellant regions 522*a* to 522*c* and an initiator system 512 of the rocket motor 500.

In this example, the internal dividers 524*a* to 524*c* are fastened to the base 520 by fasteners 518 (for example, bolts). A first divider 524*c* is positioned at the centre of the cross section of the rocket motor 500. A second divider 524*b* provides a first internal annular wall around the first divider 524*c* and within the exterior side wall 516. A third divider 524*c* provides a second internal annular wall around the second divider 524*b* and within the exterior side wall 516.

Each divider 524*a* to 524*c* has, at its distal end, an outwardly tapered region 528 followed by an inwardly tapered region 526. The inwardly tapered region 526 is positioned at the extremity of the distal end of each divider 524*a* to 524*c*. The outwardly tapered regions 528 provide an exit choke which causes exhaust gases resulting from propellant burning in the propellant regions 522*a* to 522*c* to compress. The inwardly tapered regions 526 cause the exhaust gases to expand, following compression.

The cross-sectional area defined by the outwardly tapered regions 528 provides an exit choke that is a relatively high proportion of the total cross-sectional area of the rocket motor 500 (for example, the cross-sectional area of the exit choke may be anything from 30% to 70% of the total cross sectional area of the rocket motor 500). A large exit choke minimises internal pressure in the rocket motor 500, enabling the rocket motor 500 to be formed from relatively low-weight materials.

As mentioned above, the rocket motor 500 comprises an initiator system 512. In this example, the initiator system 512 is provided by a wire arrangement that extends above each of the propellant regions 522*a* to 522*c*. The initiator system 512 may be made from a material that causes the propellant to ignite a very short time after activation of the initiator system 512. For instance, the initiator system 512 may be made from materials such as aluminium/iron oxide, copper oxide/aluminium, copper oxide/magnesium, polytetrafluoroethylene/magnesium or aluminium/palladium-ruthenium alloys. The apparatus 10 may further comprise a capacitor of an appropriate size in order to activate the initiator system 512 with a sufficiently large electrical current.

Use of one of the initiator systems 512 described above advantageously allows maximum thrust from the rocket motor 500 to be achieved within 5-10 milliseconds of detecting the initial blast shockwave from an explosion. This enables the apparatus 10 to counteract the forces produced from the explosion very quickly.

The rocket motor 500 may, for example, have a high diameter to length ratio (for instance, in the region of 3:1), to allow a large surface area of propellant (in the propellant regions 522*a* to 522*c*) to be exposed to sparks from the initiation system 512. This enables a large amount of propellant to be ignited at a time, resulting in a very high thrust being provided for a very short duration.

The propellant regions 522*a*-522*c* may include a honeycomb structure (for example, made from aluminium or Nomex®) that is coated in propellant. The cells of the honeycomb structure provide sparks from the initiator system 512 with access to the propellant and hot gases. This also enables the rocket motor 500 to achieve high thrust levels in a very short space of the time (for example, 5 to 10 milliseconds). An alternative to the honeycomb structure might be open frame structure pellets, similar to wire wool, that have an open structure which provides the sparks from the initiator system 512 with access to the propellant.

It will be appreciated by those skilled in the art that alternative rocket motor 500 designs to that illustrated in FIGS. 6A to 6C may be used in embodiments of the invention. In some alternative embodiments of the invention, a rocket motor may comprise a plate, positioned beneath the cover 514, which provides an exit choke area instead of the internal dividers. Apertures in the plate may provide a plurality of exit chokes. The exit choke area provided by the apertures may be around 60% of the total cross-sectional area of the rocket motor. In other alternative embodiments of the invention, the rocket motors may not comprise any such plate or any internal dividers 524*a* to 524*c*.

Following activation of one or more of the vehicle stabilizing devices 18, the functional processing circuitry 12 may monitor inputs provided by one or more of the accelerometers 19 periodically to determine whether the vehicle 2 remains at risk of de-stabilization from the explosion. Once the functional processing circuitry 12 determines that the risk is no longer present (e.g. because the inputs provided by the accelerometers 19 have reduced beyond a threshold level), it may de-activate the vehicle stabilizing devices 18. For example, the functional processing circuitry 12 may not fire any additional rocket motors.

It may be that the vehicle 2 comprises one or more weapons. The firing of a weapon may result in shockwaves, causing an increase in pressure local to the vehicle 2. The functional processing circuitry 12 may be configured to receive an input from the weapon (or other electronic circuitry connected to the weapon) indicating that the weapon has been fired. This enables the functional processing circuitry 12 to differentiate between a local increase in pressure caused by a blast shockwave from a hostile explosion, and a shockwave caused by the vehicle's weaponry.

The blocks illustrated in FIG. 5 may represent steps in a method and/or sections of code in the computer program 21. The illustration of a particular order to the blocks does not necessarily imply that there is a required or preferred order for the blocks and the order and arrangement of the block may be varied. Furthermore, it may be possible for some steps to be omitted.

Although embodiments of the present invention have been described in the preceding paragraphs with reference to various examples, it should be appreciated that modifications to the examples given can be made without departing from the scope of the invention as claimed. For example, in some alternative embodiments of the invention, the functional processing circuitry 12 may not use stored control information to determine how to control the vehicle stabilizing devices 18 in response to a detected increase in pressure. The functional processing circuitry 12 may merely activate the vehicle stabilizing devices 18 if the input from the pressure detectors 16 indicates that the pressure has increased above a threshold level.

In the illustrated embodiments of the invention, the vehicle stabilizing devices 18 are attached to the roof of the vehicle 2 using a support 200. However, it will be appreciated by those skilled in the art that the vehicle stabilizing devices 18 could be situated in a number of other positions in or on the vehicle 2, such as in the wings or in the engine bay above the front wheel suspension points.

The vehicle 2 is illustrated in FIGS. 2 and 3 as having wheels 28*a* to 28*d* that do not run on tracks. However, in some embodiments of the invention, the vehicle 2 may comprise wheels that run on tracks (e.g. where the vehicle 2 is a tank).

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A vehicle, comprising:

one or more detectors for detecting an explosion underneath the vehicle;

a first rocket motor arranged to apply a first groundwards force to the vehicle;

a second rocket motor arranged to apply a second groundwards force to the vehicle; and processing circuitry, configured to:

receive one or more inputs from one or more detectors indicative of an explosion underneath the vehicle;

detect, by processing at least the one or more inputs, that the explosion has occurred underneath the vehicle;

respond to detection of the explosion by causing the first rocket motor to apply the first groundwards force to the vehicle in order to stabilize the vehicle in response to the explosion; and monitor whether the vehicle remains at risk of de-stabilization from the explosion, after causing the first rocket motor to apply the first groundwards force to the vehicle and, in response to determining that the vehicle no longer remains at risk of de-stabilization from the explosion, refraining from causing the second rocket motor to apply the second groundwards to the vehicle.

2. The vehicle of claim 1, wherein the processing circuitry is configured to cause the first groundwards force to be applied to the vehicle within 10 milliseconds of detection of the explosion.

3. The vehicle of claim 1, wherein the vehicle comprises one or more accelerometers, and monitoring whether the vehicle remains at risk of de-stabilization from the explosion comprises monitoring inputs provided by the one or more accelerometers.

4. The vehicle of claim 1, wherein the one or more detectors are one or more pressure detectors.

5. The vehicle of claim 1, wherein the vehicle comprises a third rocket motor for applying a groundwards force to the vehicle, and the processing circuitry decides whether to activate the third rocket motor to apply a third groundwards force to the vehicle when the first rocket motor is activated to apply the first groundwards force to the vehicle, based at least in part on the one or more inputs from the one or more detectors.

6. The vehicle of claim 1, wherein the first groundwards force is applied to the vehicle while an upwards force, resulting from the explosion, is being applied to the vehicle.

7. The vehicle of claim 1, wherein the vehicle is a land-based vehicle.

* * * * *